US005428856A

United States Patent [19]

Thorne

[11] Patent Number: 5,428,856

[45] Date of Patent: Jul. 4, 1995

[54] PLAYING CARD CLEANING APPARATUS AND ADJUSTABLE ROLLERS THEREFOR

[75] Inventor: Paul M. Thorne, Anacortes, Wash.

[73] Assignee: ZIPS Card Playing System, Inc., La Conner, Wash.

[21] Appl. No.: 159,303

[22] Filed: Nov. 29, 1993

[51] Int. Cl.[6] ..... B08B 1/02

[52] U.S. Cl. ..... 15/102; 15/77; 134/9

[58] Field of Search ..... 15/77, 102, 88.3, 103.5, 15/230.11; 118/114, 116, 249, 258, 260, 264, 268; 134/6, 9

[56] References Cited

U.S. PATENT DOCUMENTS

| | | | |
|---|---|---|---|
| 1,586,905 | 6/1926 | Leightliner | 15/102 |
| 2,500,568 | 3/1950 | Puschel et al. | 15/102 |
| 2,929,088 | 3/1960 | Weir, Jr. | 15/102 |
| 3,098,249 | 7/1963 | Tice et al. | 15/102 |
| 3,128,492 | 4/1964 | Hanscom et al. | 15/77 |
| 3,129,535 | 4/1964 | Slattery | 15/102 |
| 3,448,479 | 6/1969 | Cademartori | 15/230.11 |
| 3,800,349 | 4/1974 | Green | 15/102 |
| 4,129,919 | 12/1978 | Fitch et al. | 15/77 |
| 4,208,233 | 6/1980 | Iwanaga | 15/102 |
| 4,382,308 | 5/1983 | Curcio | 15/77 |
| 4,504,995 | 3/1985 | Zippwald | 15/102 |
| 5,037,216 | 8/1991 | Nubson et al. | 15/102 |
| 5,040,259 | 8/1991 | Ishii et al. | 15/77 |

FOREIGN PATENT DOCUMENTS

| | | | |
|---|---|---|---|
| 126180 | 1/1932 | Germany | 15/77 |

*Primary Examiner*—David A. Scherbel
*Assistant Examiner*—Tony G. Soohoo
*Attorney, Agent, or Firm*—William H. Maxwell

[57] ABSTRACT

A playing card cleaning apparatus and wetting-scrubbing rollers, wherein playing cards are separated from a deck thereof by an extraction and card spacing roller, and fed between pairs of traction, wetting-scrubbing, and squeegee rollers, the cards being wetted with a film of cleaning solution from a transfer roller, and cleaned cards withdrawn in a damp condition from the squeegee rollers, the wetting-scrubbing rollers operating at differential speed to apply the film of cleaning solution to and to scrub the top and bottom surfaces of the cards, the squeegee rollers substantially removing the solution and leaving the cards damp, and drying means of absorbent belting to remove the dampness from the cards, the cards being discharged successively, and employing liquid cleaning agents to wet the cards that are sequentially scrubbed top and bottom and from which said cleaning agents are wiped.

15 Claims, 4 Drawing Sheets

PLAYING CARD CLEANING APPARATUS AND ADJUSTABLE ROLLERS THEREFOR

BACKGROUND OF THE INVENTION

Gaming houses, casinos, and the like are the consumers of large numbers of playing cards, each deck thereof being comprised of 52 basic cards used in conducting various games such as Poker, Blackjack and Bakerat. The standardized sizes of playing cards vary, the smaller cards being $2\frac{1}{4}\times3\frac{1}{2}$ inch, and the larger cards being $2\frac{1}{2}\times3\frac{1}{2}$ inch. These are the widely used sizes of reusable plastic cards that are this day replacing more expendable paper cards. However, continued use of plastic cards requires their frequent cleaning, as they are handled by countless numbers of persons and are subject to soiling with greasy hands, food and drink. Further, the card players demand clean cards, and it has been former practice of the gaming houses and casinos to wash them by hand or by cleaning apparatus such as the subject matter of U.S. Pat. No. 4,504,995 issued Mar. 19, 1985 to John C. Zippwald, Sr. It is a general object of this invention to improve upon the Zippwald apparatus for the cleaning of playing cards,whether they be of paper or plastic, and whether they be of the small or large standard size.

Playing cards are made of stiff paper or plastic of about 0.012 inch in thickness and having a hard and smooth finish. They are susceptible to becoming soiled and dirty when handled by person after person, it being an object of this invention to clean playing cards in public establishments, for the purpose of improving health conditions, as well as to enhance the condition of the cards for playing and to preserve them.

The apparatus for cleaning playing cards as it will be described herein involves separation of individual cards from a deck thereof and sequentially feeding, separating, scrubbing and drying the same, and reestablishing the cards in deck formation. It is an object of this invention to automate the foregoing generalized process steps by providing complementary means therefor. With the present invention, automation is by electric motor means and inherently synchronized and virtually jamb-proof means, there being the discrete application of a liquid cleaning solution whereby the individual cards are wetted, scrubbed and dried.

Decks of playing cards are commonly stored in a box of one or more decks, and it is such a feed box in which decks of cards are loaded into the apparatus of the present invention. It is an object of this invention to provide an extracting means that withdraws one card at a time from the shoe supply thereof and separates and feeds them sequentially to a scrubbing means. It is also an object of this invention to provide scrubbing means that applies an adequate amount of liquid cleaning solution to both top and bottom scrubbing rollers for cleaning both sides of the cards while transporting them to a drying means. And it is also an object of this invention to provide a drying means that absorbs moisture from the opposite top and bottom sides of the cards and delivers them into a receptacle for their subsequent use in a cleaned condition.

A characteristic feature of the apparatus as it will be hereinafter described is the use of effective liquid solutions for performing dirt loosening, scrubbing and wipe-clean functions, step by step, and the use of softening agents of the non ionic and cationic types. It is an object of this invention to reduce and/or to prevent "static cling", which would otherwise interfere with the transport and discharge of the playing cards. With the present invention the aforesaid softening agents are in a solution of carbonated water transfered to the opposite sides of the cards in a thin film simultaneously with a scrubbing action; a solution for dirt removal and adapted to be wiped clean.

Cleanliness is the foremost requirement of playing card cleaning, and it is obvious that the apparatus collects dirt and grime. In practice dripping of moisture from the cleaning operation is minimal, since the scrubbing rollers pick up and transfer a discrete thin film of cleaning solution. However, it is necessary to transfer cleaning solution from bottom rollers to top rollers, this being done at the plane of playing card transport. Consequently, the playing cards must be adequately spaced, it being an object of this invention to space the playing cards as they are extracted from the deck supply thereof. It is also an object of this invention to improve and optimize the lifting and distribution of cleaning solution by bottom to top rollers from a reservoir or trough for application to both the bottoms and tops of the cards. Transfer of solution to the top rollers is between the sequentially spaced cards, The bottom scubbing roller alternately scrubs the bottom of a card and transfers solution to its companion top roller which then scrubs the top of the next following card.

As stated above, the apparatus collects dirt and grime, and therefore must be serviced and cleaned on a regular basis. Therefore, it is an object of this invention to provide access to both the scrubbing and drying sections of the apparatus, and to the cleaning soluton reservoir or trough. Characteristically, and a unique feature of this apparatus is the modular combination of rollers and roller-belt transport means, wherein the entire mechanism is cantilevered from a supporting back wall, the rollers and belts, reservoir troughs, tensioners being completely exposed and accessible at the front of the apparatus. Observation of the card cleaning operaton is not impaired in any way, nor is access for correction and service and cleaning.

SUMMARY OF THE DISCLOSURE

This invention relates to the cleaning of quality playing cards, especially those made of plastic, and of any normal size. The cards are loaded into a feed module in stack formation one to eight decks at a time, for continuous feeding of a single card at a time and sequentially separated one from the other. Accordingly, there is an extracting and separating means that withdraws and individual cards from the feed box and deposits them into a chute leading to a process plane to be engaged by the scrubbing means.

The cards are simultaneously wetted and scrubbed as they progress through the scrubbing means in the plane of processing and alternately transported forwardly by traction rollers and into engagement with scrubbing rollers. There is a speed differential between the traction and scrubbing rollers, and the frictional engagement is greater with the traction rollers than with the scrubbing rollers, so that the latter has its cleaning effect. A feature is the transfer of cleaning solution onto a bottom scrubbing roller by means of a transfer roller, whereby the bottom sides of the cards are wetted, followed by transfer of cleaning solution from the bottom scrubbing roller to the top scrubbing roller, whereby the top sides of the cards are wetted. The cards are wetted with a thin film of cleaning solution, to be distinguished from being drenched or immersed, and whereby the coefficient of friction between the cards and scrubbing rollers is controlled. Accordingly, there is a simultaneous scrubbing and wetting of the cards transported at one rate by traction rollers and rubbed at another rate by scrubbing rollers from which the thin film of cleaning solution is applied to the cards to uniformly wet them.

The cleaning solution is comprised of softening agents of the nonionic and cationic types, mixed with sodium bicarbonate in water. The cards issue from the scrubbing means in a damp condition as a result of the squeegee effect of the rollers which wipe-clean the card surfaces to substantially eliminate wetness from the card surfaces.

The drying module follows in the process plane and receives the damp cards as they issue from the scrubbing means module. Drying is by a subtle wiping action with moisture absorbent toweling belts between which the cards are drawn in a surpentine manner to have said wiping action, and each belt having an evaporation loop exposed to ventilation air to evaporate moisture and dry the belts for continued operation.

Delivery of the cleaned cards is from the drying belts and into a receptacle from which they are taken for reuse. Divider cards are inserted between decks to separate them.

The foregoing and various other objects and features of this invention will be apparent and fully understood from the following detailed description of the typical preferred form and application thereof, throughout which description reference is made to the accompanying drawings.

THE DRAWINGS

PREFERRED EMBODIMENT

Figure 1:
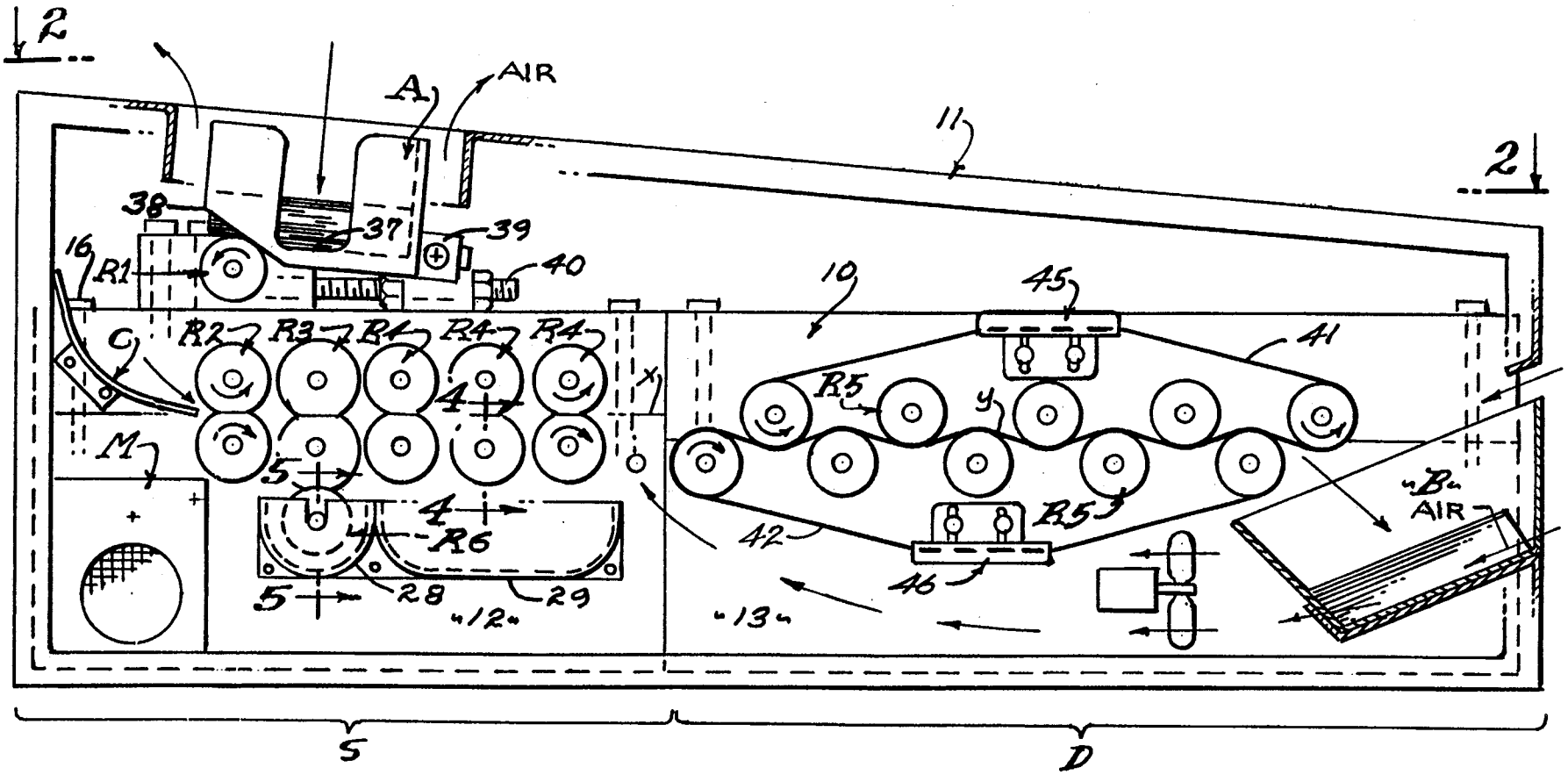
FIG. 1 is a front view of the card cleaning apparatus, with all of its mechanisms accessible.
Figure 2:
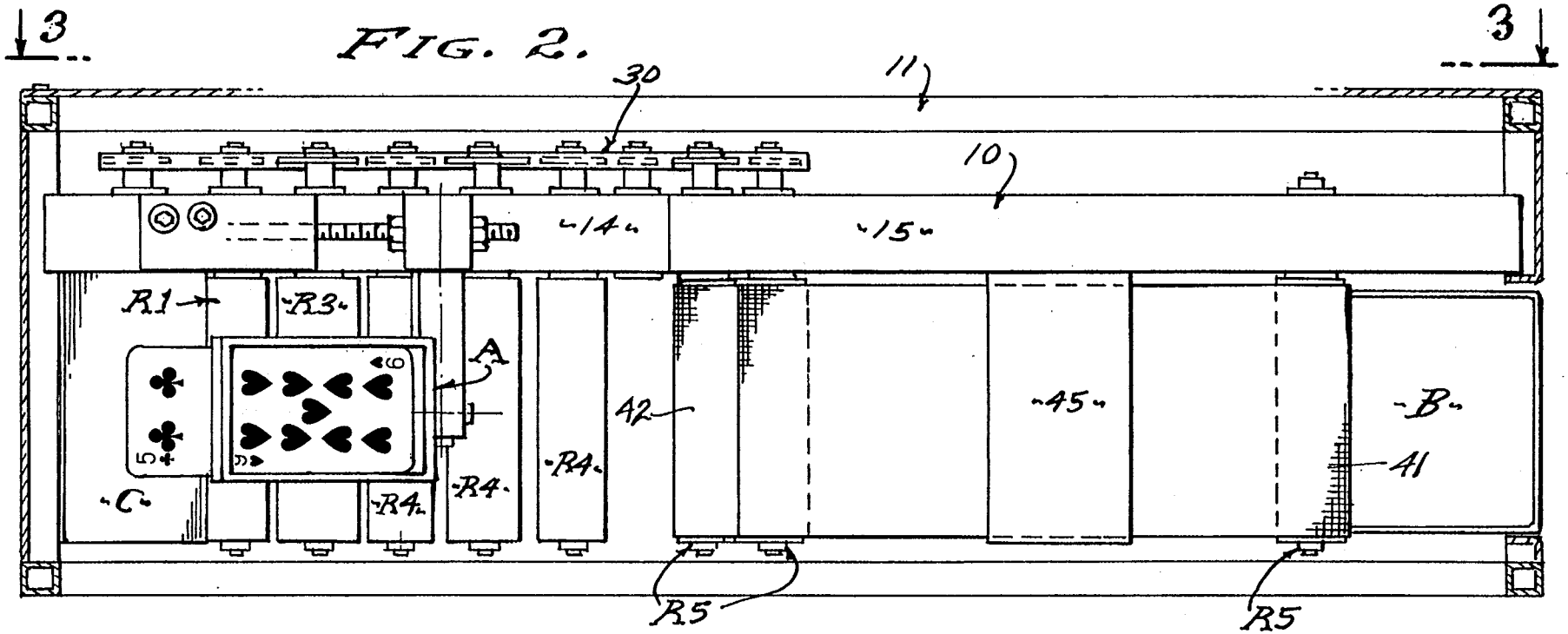
FIG. 2 is a plan view taken as indicated by line 2—2 on FIG. 1.
Figure 5:
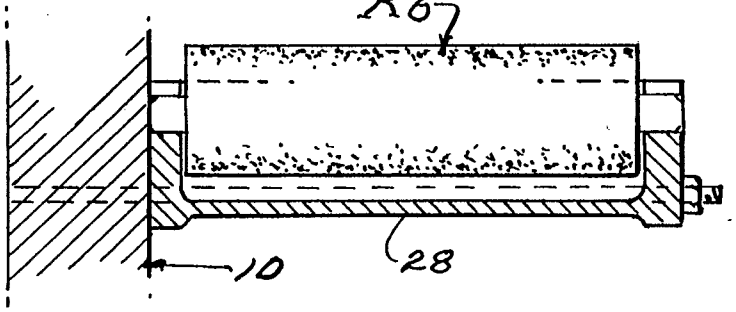
FIG. 5 is an enlarged detailed sectional view of the immersed liquid transfer roller, taken as indicated by line 5—5 on FIG. 1.

Referring now to the drawings, this is an apparatus that carries out a cleaning process characterized by the use of a nonionic—cationic cleaning solution applied to wet the playing cards that are sequentially scrubbed and wiped clean. Decks of playing cards are stacked in a feed box A from which they are individually extracted by a roller R1 and dropped via a feed chute C to a scrubbing means S at a processing plane x. At the plane x there is a sequence of processing rollers cantilevered from a single supporting back wall 10 that receive the cards and advances them in spaced relation, wetting them, scrubbing them, and wiping them clean. The cleaned cards are in a damp condition and are then trained through a drying means D that wipes them dry, to be delivered into a box B at the end of the apparatus, for subsequent reuse in a cleaned and wiped dry condition.

This apparatus is characterized by accessibility to the pairs of processing rollers that are completly exposed at the front of the apparatus. A feature is the cantilevered support of each roller and of each and every feature and/or means that participates in the card cleaning process. Accordingly, functioning of the cleaning process can be observed at each step of performance, and access for service, maintenance and repair is facilitated. Generally, there is the scrubbing means S at the feed end of the apparatus, and there is the drying means D at the delivery end of the apparatus. The cantilevered support is from a vertical wall 10 that extends coextensively within a frame 11 shown herein as a rectangular box-like cage having top and bottom rails and cross members with corner posts therebetween, a tubular weldment.

The means S and D are each comprised of lower and upper wall sections that carry pairs of processing rollers, there being lower rollers to drive, wet, scrub, squeegee and dry the bottom faces of the cards, and upper rollers to drive, wet, scrub, squeegee and dry the top faces of the cards. In accordance with this invention, the scrubbing means S is comprised of a pair of drive or traction rollers R2, followed by a pair of wetting-scrubbing rollers R3, followed by at least one pair of squeegee rollers R4, all of which roll together to advance the cards at the procesing plane x. And, the drying means D is comprised of alternately high and low rollers RS over which absorbent webbing or a belt is trained in a serpentine configuration to flex the cards so as to wipe them dry, as later described.

Figure 3:
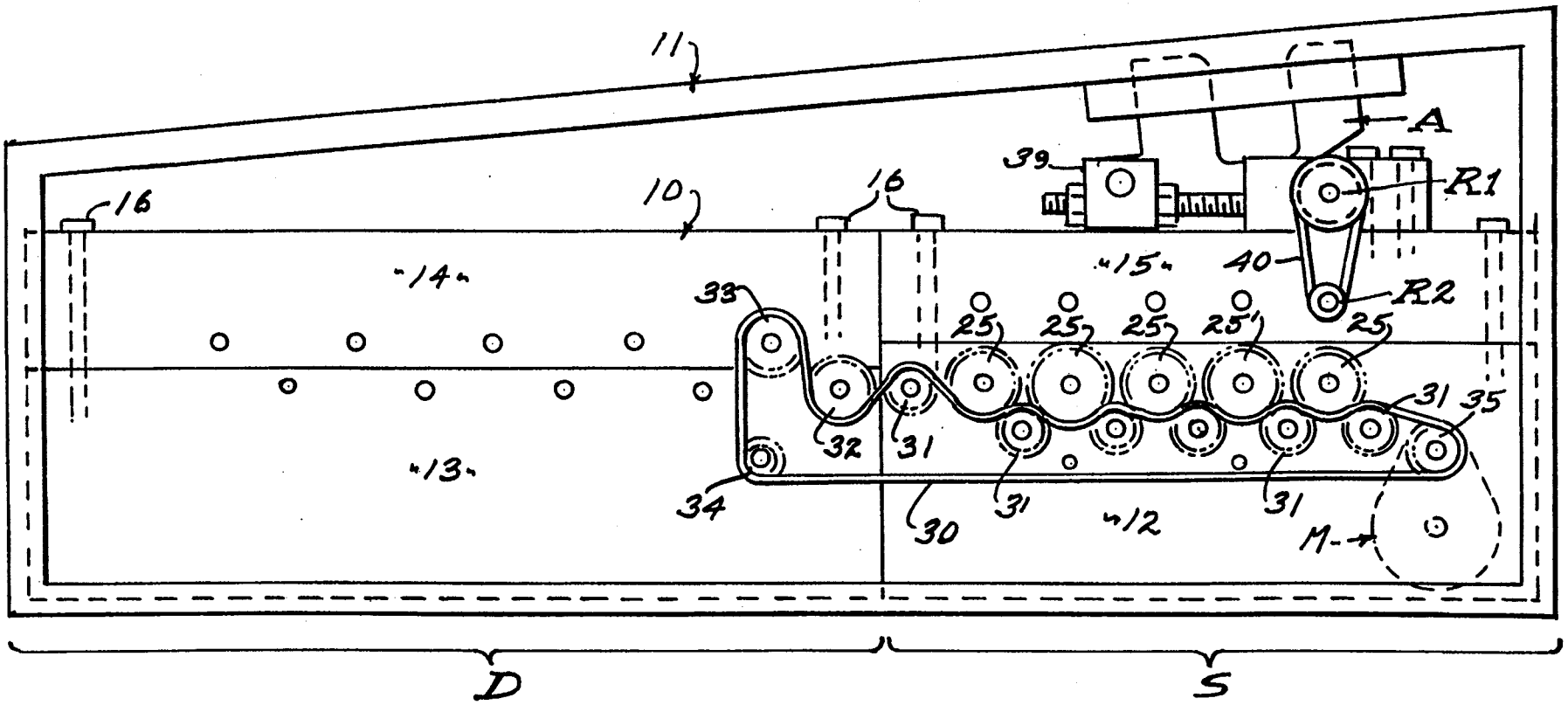
FIG. 3 is a back view taken as indicated by line 3—3 on FIG. 2 (rotated to be erect and horizontal).

As best illustrated in FIG. 3 of the drawings, the wall 10 is sectionalized, being divided into scrubbing sections supporting means S and drying sections supporting means D. As shown, there are upper and lower wall sections that are separated along the processing planes x and y, the lower sections 12 and 13 being permanently installed in the frame 11, and the upper sections 14 and 15 being individually removable. The upper sections are secured to the lower sections by fasteners 16. The upper sections 14 and 15 carry the upper rollers of the means S and D, while the lower sections 12 and 13 carry the lower rollers thereof.

Figure 4:
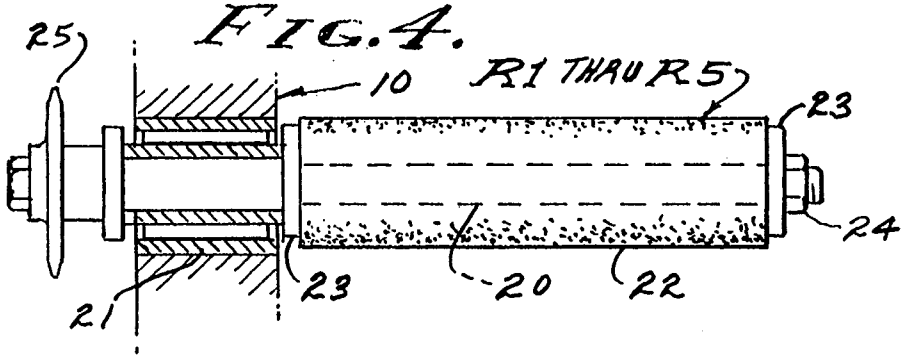
FIG. 4 is an enlarged detailed sectional view of a spindle supported roller (typical) taken as indicted by line 4—4 on FIG. 1.

In accordance with this invention and as detailed in FIG. 4 of the drawings, the rollers R1 through R5 are cantilevered to project horizontally from the wall 10. Each roller is comprised of a free turning spindle 20 supported on antifriction bearings 21 carried in a wall section and extending through the wall. The spindle 20 projects from the front of the wall section and carries a compressible sleeve 22 having a depressible cylindrical surface. The compressible sleeve 22 is captured between opposed end plates 23 that are adjusted axially by a nut 24, to control the diameter of the roller. There are two types of rollers, those which are driven and those which are idlers; FIG. 4 illustrates a driven roller having a sprocket 25 (gear or pulley) adjacent to the back side of the wall 10. As will be described, there are idler sprockets which are devoid of drive means.

Figure 6:
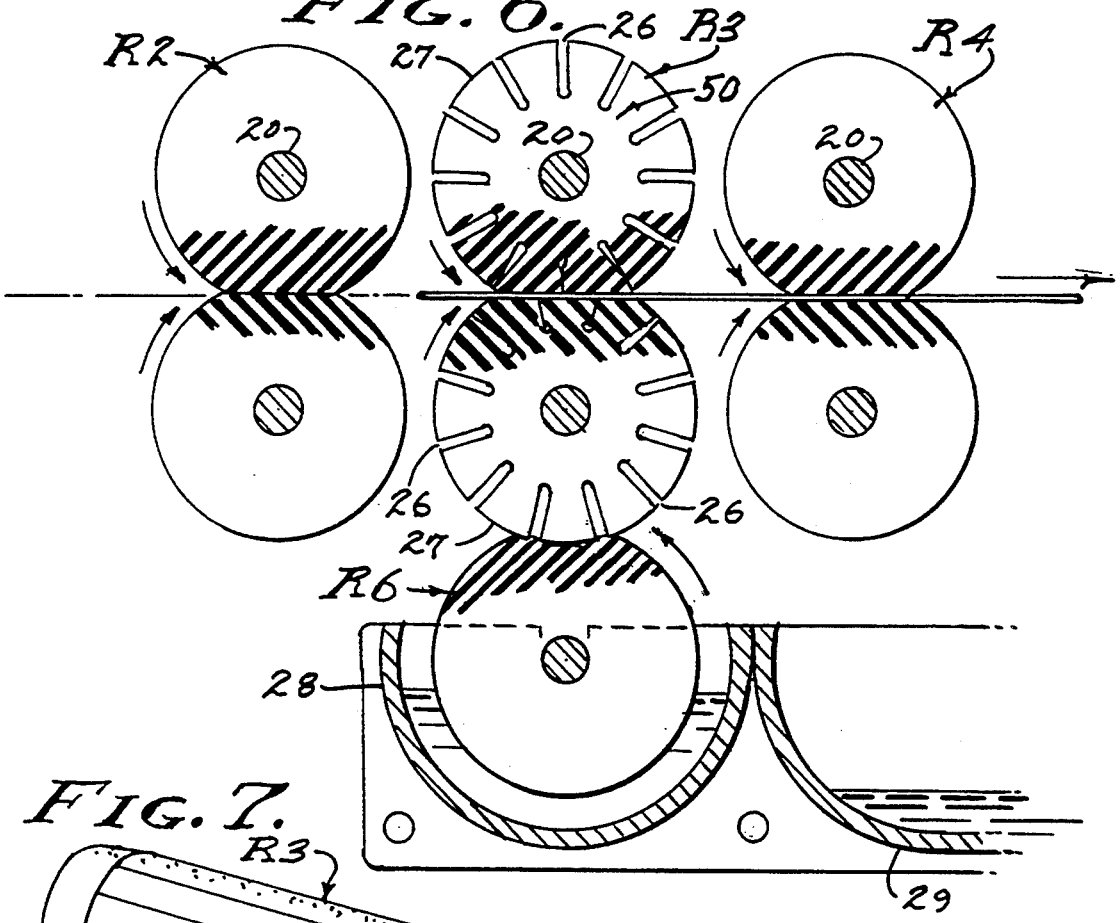
FIG. 6 is an enlarged detailed front view of the traction rollers, the wetting-scrubbing rollers, the liquid transfer roller, and squeegee rollers (as they are related in FIG. 1).
Figure 7:
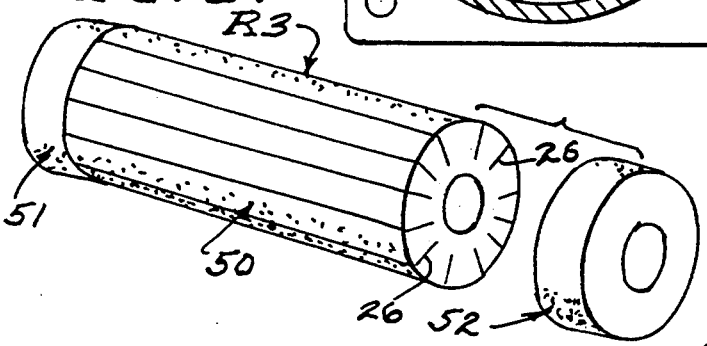
FIG. 7 is an enlarged perspective view of the wetting-scrubbing roller, removed from the apparatus.

Referring now to the scrubbing means S, and particularly to FIG. 1 of the drawings, and moving from left to right and embracing the processing plane x;

1) There is a pair of upper and lower traction rollers R2 that receive cards dropped from the feed chute C, the upper roller being carried by wall section 14, and the lower roller carried by wall section 12. The peripheral surface of the traction rollers engage the cards entering therebetween, and in practice they are pressed together as is indicated in the drawings.
2) Following the traction rollers there is a pair of upper and lower wetting-scrubbing rollers R3 that are unique with the present invention in that they are slotted rollers for the enhancement of liquid transfer from a solution pickup roller R6 to both upper and lower rollers R3 (see FIGS. 6 and 7). The rollers R3 are sectional, comprised of a center card engaging section 50 embraced by a pair of liquid barrier sections 51 and 52 at opposite ends of the roller. It is the center section 50 that is slotted at 26 as shown in FIGS. 6 and 7, the roller sections 51 and 52 being unslotted so as to present a peripheral dam to prevent discharge of liquid from opposite ends of the rollers R3. In practice, the tread width of top sections 51–52 is ⅛ inch while the tread width of bottom section 51–52 is ¾ inch (approximately). The rollers are approximately 1¼ inch diameter with 1/16 inch wide radial slots 26 extending radially 3/16 inch deep into the center section only. These slots 26 are coextensive with the cylindrical roller surface of the center section 50. As best illustrated in FIG. 6 the slots 26 collapse or close when the periphery 27 of the roller is depressed, and conversely the slots 26 expand or open when the periphery is free to return toward its full diameter.

The collapse and expansion of the depressible rollers R3 provides a liquid pumping action when the periphery of the lower roller is immersed in a liquid soluton and alternately compressed against either a card or the upper roller to discharge said liquid. That is, liquid pickup by capillary attraction into the slots 26 is transferred to either the bottom of the cards or to the upper roller for transfer to the top faces of the cards. Liquid pumped by the slotted configuration of the center section 50 is prevented from squirting from the ends of the rollers R3 by the presence of the barrier sections 51 and 52, which are depressible the same as are the center sections 50. The volume of liquid transferred by the slots 26 is substantially greater than by the mere surface contact of one smooth surfaced roller with another. As shown, there is a multiplicity of slots 26 spaced in a circumferential series around the center section 50 of the rollers R3.

3) Following the wetting-scrubbing rollers there is at least one pair of upper and lower squeegee rollers R4 that receive the wetter and scrubbed cards, to engage the top and bottom faces of the cards to remove the wetness which drops from the trailing edges of the cards as they pass through the rollers R4. In practice, there are three sucessive sets of pairs of squeegee rollers R4, for the substantially complete removal of wetness. Accordingly, the cards leave the scrubbing means in a barely damp condition The scrubbing means S is dependent for its operation upon the application of a liquid cleaning solution to both sides of the playing cards, as they are transported along the processing plane x. In accordance with this invention, this cleaning solution is applied in a thin film by providing a trough 28 in which a pickup roller R6 is immersed in a liquid solution and wetted, roller R6 being made with a resilient or compressible surface of soft material such as rubber or the like, and preferably of sponge plastic that is soft and supple and resilient. In practice, the pickup roller R6 is depressibly engaged with the lowermost scrubbing roller R3 and is driven thereby through frictional engagement. The trough 28 is in the form of a reservoir that is removably cantilevered from the wall 10, for cleaning and re-filling with cleaning solution. Next adjacent to the trough 28 there is a tray 29 for catching the solution that is squeegeed and drops from the cards passing between the rollers R4. The tray is a catch basin that is removably contilevered from the wall 10, for emptying, and it is shown to be integral with the trough 28.

Referring now to motivation of the spindle supported rollers of means S and D, and particularly to FIG. 3 of the drawings, the lower roller spindles of the scrubbing means S are all motivated, while only the first upper and lower spindles R5 of the drying means D are motivated. A chain 30 drive is preferred, driven by a geared motor drive. The chain is endless and travels between the means S and D to drive the sprocketed spindles 20, there being an idler sprocket 31 between the spindle sprockets 25, and between the last squeegee roller sprocket and the first drying sprocket 32. As shown, the drive chain is trained between the upper spindle sprockets 25 and the lower idler sprockets 31, and ever the dryer drive sprockets 32 and 33 of the drying means D. The chain returns over an idler sprocket 34 to the drive sprocket 35.

The sprocket 25' of the wetting-scrubbing rollers R3 differs from sprocket 25 in order to operate at a different speed, preferably slower than the card transport speed through rollers R2 and R4. In practice, the rollers R3 turn approximately 20% slower than roller R2 and R4, the sprockets 25 having 14 teeth and the sprocket 25' having 17 teeth. The upper rollers R2, R3 and R4 of the scrubbing means S are frictionally driven through peripheral engagement with the lower rollers thereof (see FIG. 1).

Next adjacent to the trough 28 is a tray 29 for catching the solution that is squeegeed from the cards passing between rollers R3. The tray is a pan that is removably cantilevered from the wall 10 for emptying, and is shown to be integral with the trough 28.

In accordance with this invention, there is a card feed box A that dispenses one card at a time from a stacked supply thereof. In practice, one or more decks of playing cards are stacked in the feed box A (see FIG. 1) positioned over the set of traction rollers R2. The feed box A is provided to support and guide the stacked cards and is dimensionally proportioned to do so as shown, the top thereof being open and the opposite sides thereof cut out for finger access to the cards. The bottom 37 of the box is truncated at 38 so that the opposite sides of the box form inclined rails for support engagement with an extraction roller R1 disposed above and parallel to the top traction roller R2. Accordingly, the bottom of box A is rearwardly inclined and open so as to expose an extending portion of the bottom card to engage with the extraction roller R1. Like the rollers R2, the extraction roller R1 carries a sleeve 22 of compressible material for frictional engagement with successive cards.

Adjustment of card engagement with the top surface of extraction roller R1 is by a shiftable feed box support means, shown as a positionable block 39 supported upon the wall section 14 and adjustably positioned by a screw 40 with lock nuts (see FIG. 1). A feature is the gimbaled attachment of the feed box A to the adjustment block 39, on longituidinal and transverse axes for alignment with the periphery of the extraction roller R1. The rails of truncation 38 are inclined so that the elevation of the feed box A is adjustable for coextensive engagement of the roller with the bottom card to withdraw and drop it into the chute C which terminates at the plane x adjacent the entry between the traction rollers R2.

As shown in FIG. 3 the extraction roller R1 is driven by a speed reduction belt and pulley drive 40 from the upper traction roller R2, thereby spacing the sequentially fed cards. In practice, a speed reduction of 2 to 1 is preferred, so that the spacing of cards is approximately equal to their length.

Figure 8:
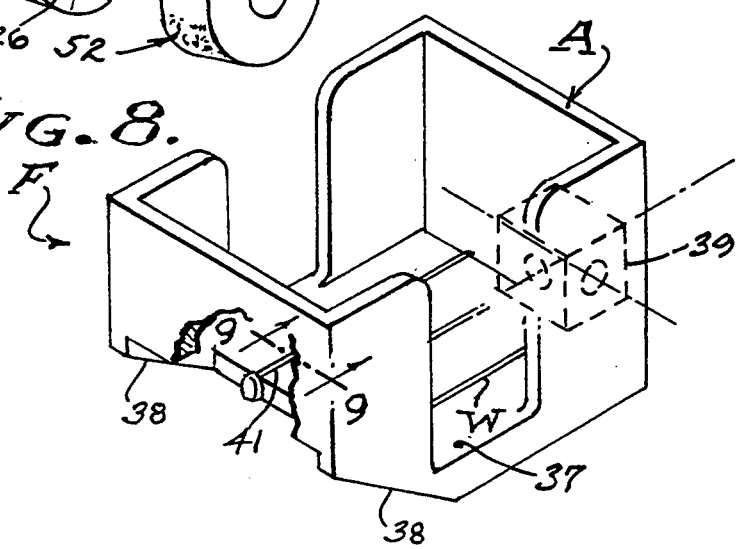
FIG. 8 is an enlarged perspective view of the card feeding box or shoe, FIG. 9 being a fragmentary section of the anti-friction wires over which the individual cards are extracted and taken as indicated by line 9—9 on FIG. 8.
Figure 9:
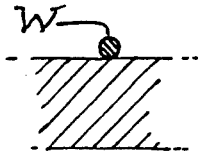

A feature of the feed box A is the anti friction wire slides W for slidably engaging the bottom cards (see FIGS. 8 and 9), three such longitudinally disposed wires being shown.

The scrubbing means S is dependent for its operation upon the application of a liquid cleaning solution to both sides of the playing cards, as they are transported along the processing plane x. In accordance with this invention, the cleaning solution is applied in a thin film by providing a trough 28 in which the pickup roller R6 is immersed in a liquid solution and wetted. In practice, the pickup roller R6 is pressibly engaged with the lowermost scrubbing roller R3 that is exposed between sequentially transported cards, and is frictionally revolved thereby and its surface continuously re-wetted as it turns.

The drying means D wipes and absorbs moisture from the tops and bottoms of the playing cards, along a serpentine processing path at plane y. The means D is characterized by top ant bottom absorbent wiping towels or belts of the same width as the rollers of the scrubbing means S. The belts are opposed to the top and bottom sides of the playing cards as they issue from the squeegee rollers R4. The top and bottom belts 41 and 42 are alike, and are made of an absorbent material and are trained over raised and lowered rollers 43 and 44 that form large upper and lower loops thereof for the evaporation of moisture therefrom. The rollers 43 and 44 are juxtapositioned so that the belts of absorbent material touch and/or press together to engage both sides of the cards transported therebetween.

In accordance with this invention, the playing cards are effectively wiped dry by the toweling through the establishment of a serpentine route of travel. As shown, the rollers 43 and 44 are driven by the rollers R5 through sprockets 25, so that the belts of toweling 41 and 42 advance at the same positive rate of speed. In practice, the drive rollers R5 are made with surfaces of resilient or compressive material such as rubber or the like. Wiping action is established by means of flexing the cards reversely upward and downward. In practice, there are five equally spaced rollers supporting both the upper and lower belts 41 and 42, and there is an intermediate tensioner means 45 and 46 engaged with each belt respectively. As the playing cards pass under and over these raised and lowered rollers R5, they are flexed and thereby wipe against said belts. Consequently, dampness is removed and the cards are discharged in a wiped dry condition when they are dropped into the box B for subsequent reuse.

Having described only the typical preferred form and application of my invention, I do not wish to be limited or restricted to the specific details herein set forth, but wish to reserve to myself any modifications or variations that may appear to those skilled in the art, as set forth within the limits of the following claims.

I claim:

1. A playing card cleaning apparatus with front accessibility for observing operation and for facilitating maintenance, and including;

an open fronted frame having a vertical back wall extending from a card reception end of the frame to a card delivery end of the frame, a card feed means cantilevered from the back wall for sequentially dispensing a stack of cards in spaced relationship to a horizontally disposed processing plane, a pair of rollers comprised of upper and lower traction rollers at the card reception end of the frame and cantilevered from the back wall to engageably rotate on bearing means for advancing cards along the processing plane toward the delivery end of the frame, a pair of rollers comprised of upper and lower wetting-scrubbing rollers following the traction rollers in the direction of advancing cards and cantilevered from the back wall to engageably rotate on bearing means for wetting and scrubbing the cards advancing along the processing plane, means cantilevered from the back wall for transferring liquid cleaning solution to the lower wetting-scrubbing roller for subsequent transfer to the upper wetting-scrubbing roller and for transfer onto opposite sides of the cards advancing between said rollers, at least one pair of rollers comprised of upper and lower squeegee rollers following the wetting-scrubbing rollers in the direction of advancing cards and cantileverd from the back wall to engageably rotate on bearing means for removing wetness from the cards advancing along the processing plane, a drying means comprised of top and bottom absorbent belts with opposed sections engageably pressed together with the cards transported therebetween at a horizontally disposed drying plane and carried by upper and lower rollers rotatably cantilevered from the back wall to rotate on bearing means for advancing cards to and from the delivery end of the frame, and drive means rotating at least one of each of said pairs of rollers and at least one drying means roller.

2. The playing card cleaning apparatus as set forth in claim 1, wherein the back wall of the frame is sectional, with at least one lower section of the back wall cantilevering the lower-bottom rollers, and with at least one removable upper section of the back wall cantilevering the upper-top rollers.

3. The playing card cleaning apparatus as set forth in claim 1, wherein the pair of upper and lower wetting-scrubbing rollers are rotated at a differential rate with respect to the traction and squeegee rollers, thereby applying a scrubbing action to the top and bottom sides of the cards.

4. The playing card cleaning apparatus as set forth in claim 1, wherein at least one of each pair of rollers is axially compressible by adjustment means for increased roller diameter and pressure applied to the card advancing between said pair of rollers.

5. The playing card cleaning apparatus as set forth in claim 1, wherein at least one of the wetting-scrubbing rollers is comprised of a sleeve of compressible material with memory and having a peripheral series of longitudinal slots formed radially therein, to attract and fill the slots with liquid by capillary attraction when the roller surface is expanded, and to discharge said liquid by a pump action when the roller surface is compressed, to control the slot discharge, and wherein at least one of each pair of rollers is axially compressible by adjustment means for increased roller diameter and pressure applied to the card advancing between said pair of rollers.

6. The playing card cleaning apparatus as set forth in claim 1, wherein the card feed means is comprised of a box having a partially open bottom to support a stack of cards while exposing a portion of the bottommost card, and a driven extraction roller aligned with said partially open bottom to frictionally engage the underside of said bottommost card and withdraw it from said stack, there being chute means for guiding sequentially withdrawn cards to the processing plane and between the traction rollers.

7. The playing card cleaning apparatus as set forth in claim 6, wherein a multiplicity of small diameter anti-friction wires disposed in the direction of card withdrawal separates the bottommost card from the partially open bottom of the box.

8. The playing card cleaning apparatus as set forth in claim 6, wherein the feed means box has downwardly faced inclined rails to rest upon the extraction roller, and adjustment means to position the rails relative to a periphery of said extraction roller for controlling the height of the box and engagement of the bottommost card with said extraction roller.

9. The playing card cleaning apparatus as set forth in claim 6, wherein the driven extractor roller revolves at a substantially reduced rate with respect to the traction rollers, thereby spacing the cards for cleaning solution transfer therebetween from the lower to the upper wetting-scrubbing rollers.

10. The playing card cleaning apparatus as set forth in claim 1, wherein at least one of the wetting-scrubbing rollers is comprised of a sleeve of compressible material with memory and having a peripheral series of longitudinal slots formed radially therein, to attract and fill the slots with liquid by capillary attraction when the roller surface is expanded, and to discharge said liquid by a pump action when the roller surface compressed, to control the slot discharge.

11. The playing card cleaning apparatus as set forth in claim 10, wherein the wetting-scrubbing roller is sectional, having a center section that is slotted for liquid pickup and discharge, and having opposite end sections that are non-slotted and thereby present circular dams locating opposite ends of the slots and position of discharge.

12. The playing card cleaning apparatus as set forth in claim 10, wherein the wetting-scrubbing roller is sectional, having a center section that is slotted for liquid pickup and discharge, and having opposite end sections that are non-slotted and thereby present circular dams locating opposite ends of the slots and position of discharge, and wherein at least one of each pair of rollers is axially compressible by adjustment means for increased roller diameter and pressure applied to the card advancing between said pair of rollers.

13. The playing card cleaning apparatus as set forth in claim 1, wherein the upper and lower wetting-scrubbing rollers are comprised of a sleeve of compressible material with memory and each having a peripheral series of longitudinal slots formed radially therein, to attract and fill with liquid by capillary attraction when the roller surfaces are relaced, and to discharge said liquid by a pump action when the roller surfaces are compressed to constrict the slots.

14. The playing card cleaning apparatus as set forth in claim 13, wherein the wetting-scrubbing roller is sectional, having a center section that is slotted for liquid pickup and discharge, and having opposite end sections that are non-slotted and thereby present circular dams locating opposite ends of the slots and position of discharge.

15. The playing card cleaning apparatus as set forth in claim 14, wherein the tread width of the lower wetting-scrubbing rollers are narrow whereas the tread width of the upper wetting-scrubbing rollers are wide, to reduce endwise discharge or liquid while maximizing liquid pickup.

* * * * *